US006941093B2

(12) United States Patent
Park et al.

(10) Patent No.: US 6,941,093 B2
(45) Date of Patent: Sep. 6, 2005

(54) PHOTORECEPTIVE UNIT AND TRANSFER UNIT REPLACEMENT SYSTEM OF PRINTER

(75) Inventors: Moon-bae Park, Gyeonggi-do (KR); Heung-sup Jeong, Gyeonnggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 41 days.

(21) Appl. No.: 10/439,330

(22) Filed: May 16, 2003

(65) Prior Publication Data

US 2004/0009008 A1 Jan. 15, 2004

(30) Foreign Application Priority Data

Jul. 9, 2002 (KR) ..... 2002-39733

(51) Int. Cl.[7] ..... G03G 15/02; G03G 15/00; G03G 15/08

(52) U.S. Cl. ..... 399/116; 399/117; 399/121

(58) Field of Search ..... 399/37, 88, 90, 399/111, 113, 114, 117, 116, 121, 125, 302, 308, 107

(56) References Cited

U.S. PATENT DOCUMENTS 6,522,845 B2 * 2/2003 Sameshima ..... 399/88

FOREIGN PATENT DOCUMENTS

JP 8-54786 2/1996

* cited by examiner

*Primary Examiner*—Hoang Ngo
(74) *Attorney, Agent, or Firm*—Staas & Halsey LLP

(57) ABSTRACT

A photoreceptive unit and transfer unit replacement system of a printer includes a door opening and closing an entrance formed above a portion where a photoreceptive unit and a transfer unit are installed in a main body of the printer. A first guide rail is provided at a frame of the main body to guide the photoreceptive unit which enters through the entrance and descends. A second guide rail is provided at the frame to guide the transfer unit which enters through the entrance and descends. A locking unit locks and unlocks the photoreceptive unit and the transfer unit according to an operation of opening and closing the door. Thus, since the operation of opening and closing the door are performed according to the operation of locking and unlocking the respective photoreceptive unit and transfer units, and the photoreceptive unit and transfer units pass through the entrance disposed above the units, a replacement process can be performed more conveniently and stably.

63 Claims, 9 Drawing Sheets

PHOTORECEPTIVE UNIT AND TRANSFER UNIT REPLACEMENT SYSTEM OF PRINTER

CROSS-REFERENCE TO RELATED APPLICATIONS

This application claims the priority of Korean Patent Application No. 2002-39733 filed on Jul. 9, 2002, in the Korean Intellectual Property Office, the disclosure of which is incorporated herein in its entirety by reference.

BACKGROUND OF THE INVENTION

1. Field of the Invention

The present invention relates to a system for replacing a photoreceptive unit and a transfer unit in a printer.

2. Description of the Related Art

A typical printer, such as a printer or a copier, includes a photoreceptive unit developing an image and a transfer unit transferring the developed image to a sheet of paper. As the photoreceptive unit and the transfer unit are used for a long period of time, a degree of accuracy of an image deteriorates. Thus, in order to maintain a clean image, the photoreceptive unit and the transfer unit need to be replaced after being used for a longer period.

FIGS. 1 through 5 are views showing an operation of a conventional system for replacement of the photoreceptive unit and the transfer unit.

Referring to FIGS. 1 through 5, first and second guide rails 41 and 42 are provided in a printer, and a photoreceptive unit 10 and a transfer unit 20 are slidably supported by the first and second guide rails 41 and 42, respectively. To replace the photoreceptive unit 10 and the transfer unit 20, a door (not shown) provided at a front side of the printer is opened, and a locking lever 30 barring the photoreceptive unit 10 is rotated toward the transfer unit 20. Here, the locking lever 30 slightly lifts the transfer unit 20 to be separated from the photoreceptive unit 10. As shown in FIG. 3, the photoreceptive unit 10 is drawn out from the printer by holding a first handle 11 of the photoreceptive unit 10 and pulling the same along the first guide rail 41. Next, the locking lever 30 is disposed to be back to its original position as shown in FIG. 4. Then, a second handle 21 of the transfer unit 20 is pulled to draw the transfer unit 20 along the second guide rail 42. Here, when the transfer unit 20 is drawn to a certain degree, the transfer unit 20 is taken, not to be fallen down, by holding a third handle 22 installed at an upper surface of the transfer unit 20. The installation of new units is carried out in a reverse order to the above-described process.

In the above replacement system, however, the locking lever 30 is inconveniently lifted up and down whenever the photoreceptive unit 10 and the transfer unit 20 are pulled and installed. Also, since the respective units 10 and 20 are pulled by holding the first and second handles 11 and 21 installed at a front side thereof to be drawn, the photoreceptive and transfer units 10 and 20 may fall down at a moment of escaping from the first and second guide rails 41 and 42 and easily damaged if the photoreceptive and transfer units 10 and 20 are carelessly handled, for example, when the photoreceptive and transfer units 10 and 20 are strongly pulled out.

SUMMARY OF THE INVENTION

To solve the above and/or other problems, the present invention provides a photoreceptive unit and transfer unit replacement system of a printer by which a replacement work can be carried out safely and easily.

Additional aspects and advantages of the invention will be set forth in part in the description which follows and, in part, will be obvious from the description, or may be learned by practice of the invention.

According to an aspect of the present invention, a photoreceptive unit and transfer unit replacement system of a printer includes a door opening and closing an entrance formed above a portion where a photoreceptive unit and a transfer unit are installed in a main body of the printer, a first guide rail provided at a framed in the main body to guide the photoreceptive unit which enters through the entrance and descends, a second guide rail provided at the frame to guide the transfer unit which enters through the entrance and descends, and a locking unit locking and unlocking the photoreceptive unit and the transfer unit according to an operation of opening and closing the door.

According to another aspect of the invention, the locking unit includes a locking lever rotatably installed at the frame and having a hook portion hooked by a boss provided at each of the photoreceptive unit and the transfer unit, and an interaction mechanism allowing an operation of opening and closing the door to be interacted with a rotation of the locking lever. When the door is closed, the locking lever is rotated in a first direction, and the hook portion is hooked by the boss to lock a corresponding one of the photoreceptive unit and the transfer unit. When the door is opened, the locking lever is rotated in a second direction so as to be unlocked from the hook portion.

According to another aspect of the invention, a photoreceptive unit and transfer unit replacement system of a printer having a photoreceptive unit and a transfer unit includes a door opening and closing an entrance formed on the main body where the photoreceptive unit and the transfer unit are installed in the main body of the printer, first and second frames disposed on both sides of the photoreceptive unit and the transfer unit in a direction perpendicular to rotation axes of the photoreceptive unit and the transfer unit, and a guide rail formed on at least one of the first and second frames to guide the photoreceptive unit and the transfer unit to an installation position of the main body through the entrance.

According to another aspect of the invention, a photoreceptive unit and transfer unit replacement system of a printer having a photoreceptive unit and a transfer unit contained in a main body includes a door opening and closing an entrance formed on the main body, first and second frames parallel to each other and formed in a direction perpendicular to rotation axes of the photoreceptive unit and the transfer unit so that the photoreceptive unit and the transfer unit are disposed between the first and second frames, a first guide rail formed on at least one of the first and second frames, a first side plate formed on the photoreceptive unit in a first direction parallel to the first and second frames, a first boss formed on the first side plate of the photoreceptive unit in a second direction parallel to the rotation axis of the photoreceptive unit, and disposed on the first guide rail, a second guide rail formed on at least one of the first and second frames, a second side plate formed on the transfer unit in the first direction parallel to the first and second frames, and a second boss formed on the second side plate of the transfer unit in the second direction parallel to the rotation axis of the transfer unit, and disposed on the second guide rail.

According to another aspect of the invention, the first and second guide rails are formed in a direction having an angle with a paper path of a sheet of paper passing through a nip between the photoreceptive unit and the transfer unit.

According to another aspect of the invention, the system includes a locking unit having a first locking portion and a second locking portion coupled to the transfer unit and the photoreceptive unit, respectively, wherein the first locking portion and the second locking portion are formed in a direction from the transfer unit to the photoreceptive unit.

According to another aspect of the invention, the system includes a locking unit rotatably mounted on the one of the first and second frame to rotate according to a movement of the door, and having a first locking portion and a second locking portion locking the transfer unit and the photoreceptive unit, respectively.

According to another aspect of the invention, the photoreceptive unit and the transfer unit are mounted in the main body through the entrance, and the transfer roller includes a first side facing the photoreceptive unit, and a second side facing the entrance of the main body.

According to another aspect of the invention, the photoreceptive unit, the transfer unit, and the entrance are disposed in the main body a line parallel to the first and second frames.

According to another aspect of the invention, the photoreceptive unit, the transfer unit, and the entrance are disposed in the main body a line having an angle with a paper path of a sheet of paper passing through a nip between the photoreceptive unit and the transfer unit.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
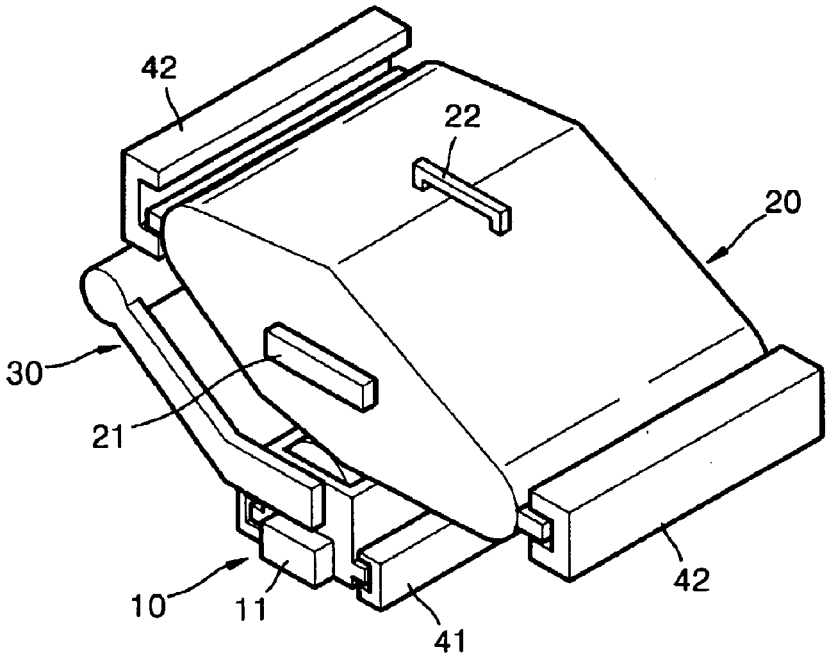
FIG. 1 (PRIOR ART)
FIGS. 1 through 5 are views showing an operation of a conventional photoreceptive unit and transfer unit replacement system.
Figure 2:
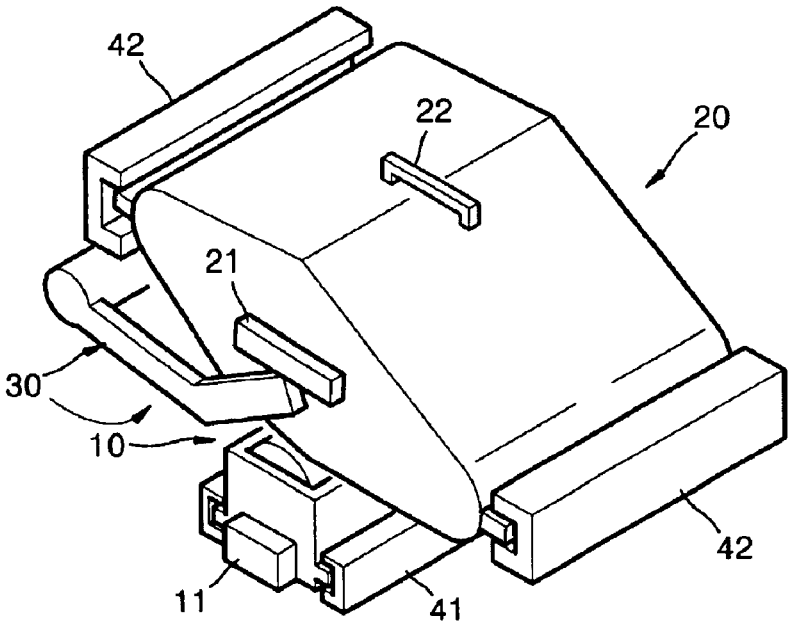
FIG. 2 (PRIOR ART)
Figure 3:
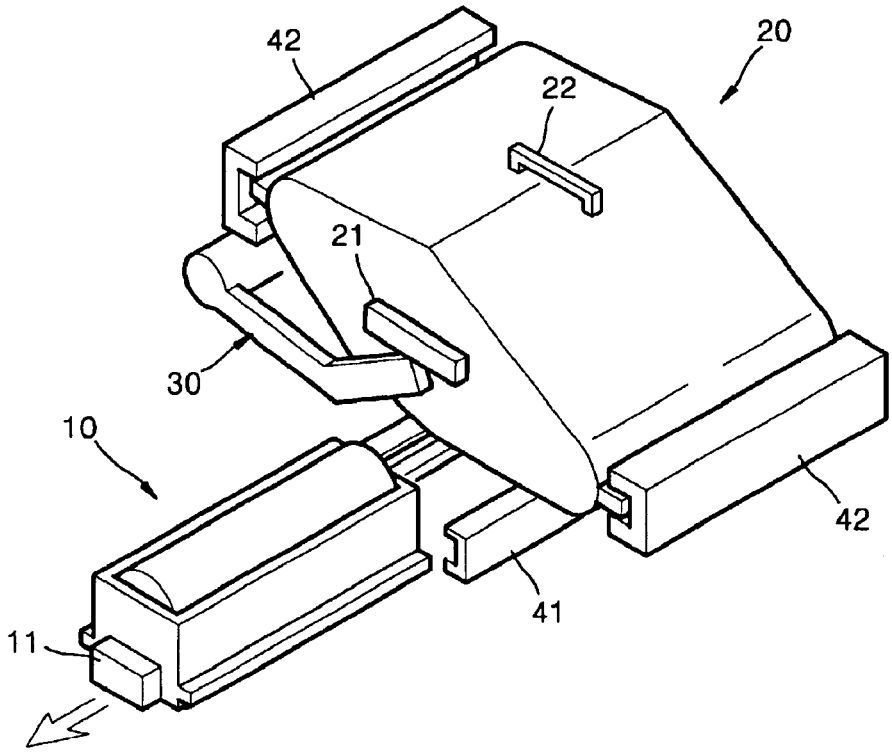
FIG. 3 (PRIOR ART)
Figure 4:
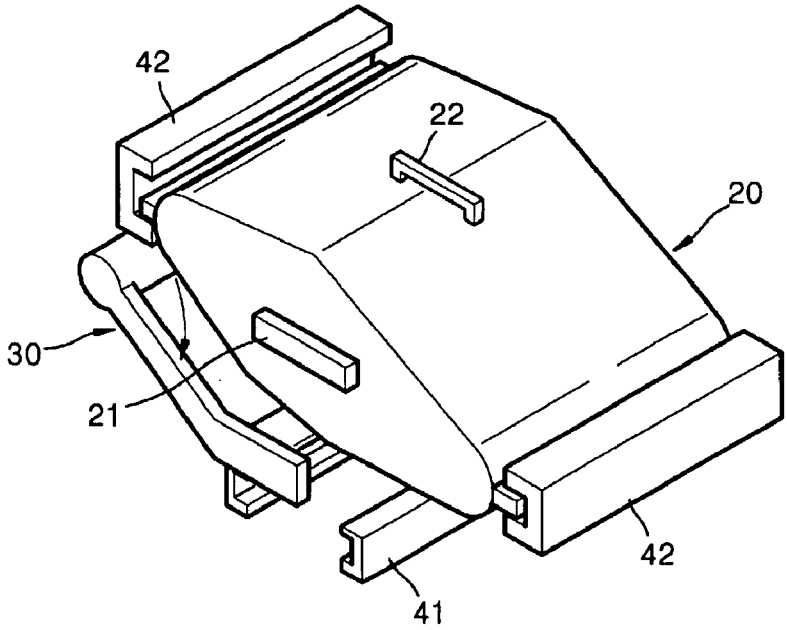
FIG. 4 (PRIOR ART)
Figure 5:
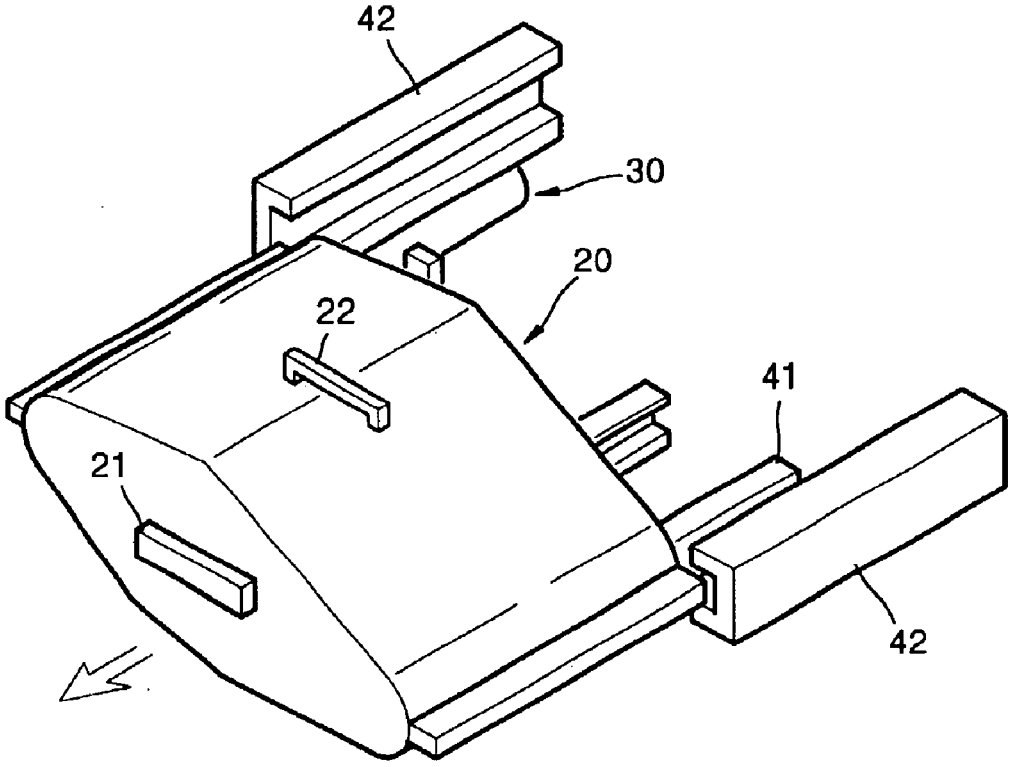
FIG. 5 (PRIOR ART)

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 6:
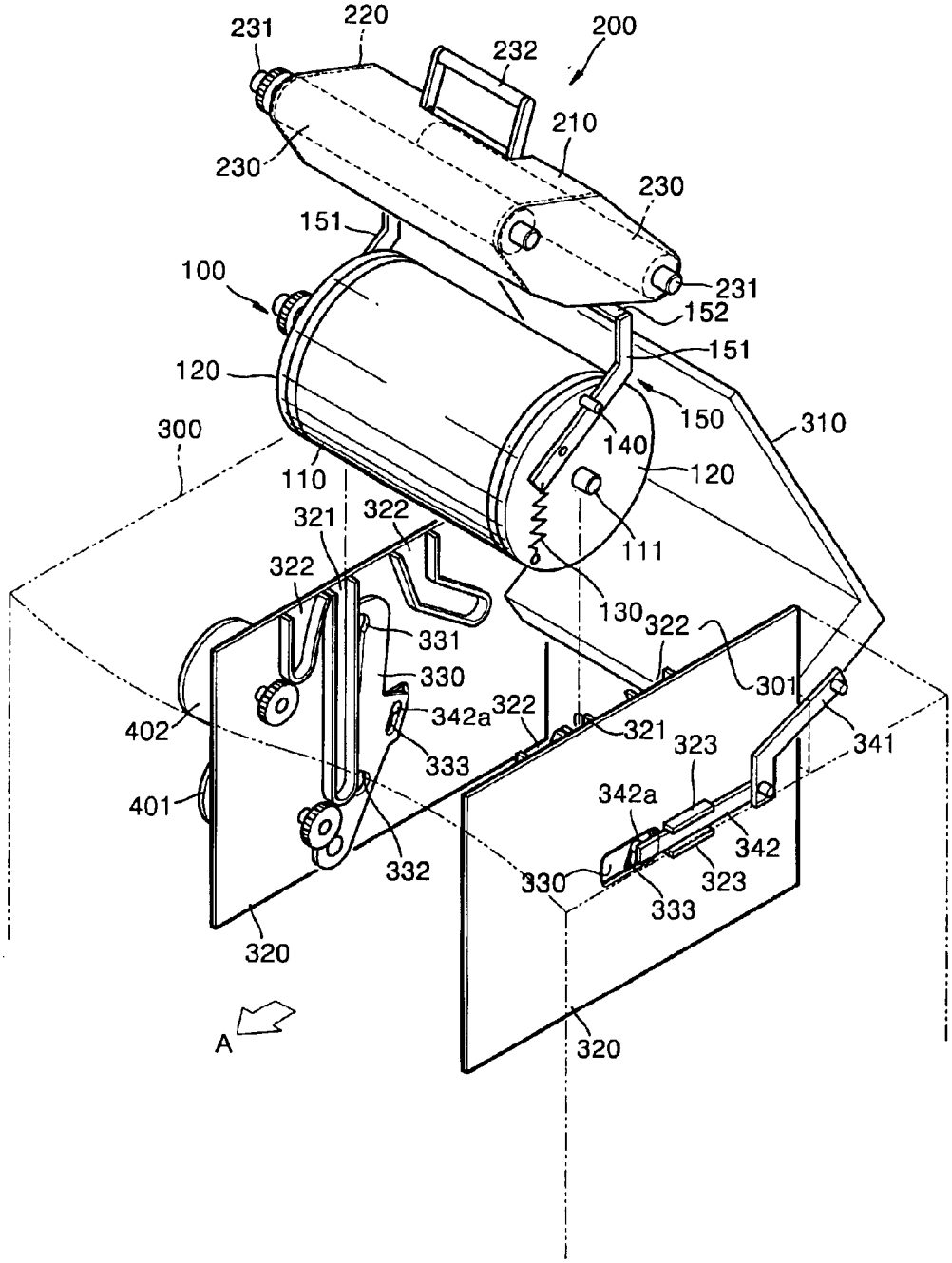
FIG. 6 is a view showing a structure of a photoreceptive unit and transfer unit replacement system according to an embodiment of the present invention.
Figure 7:
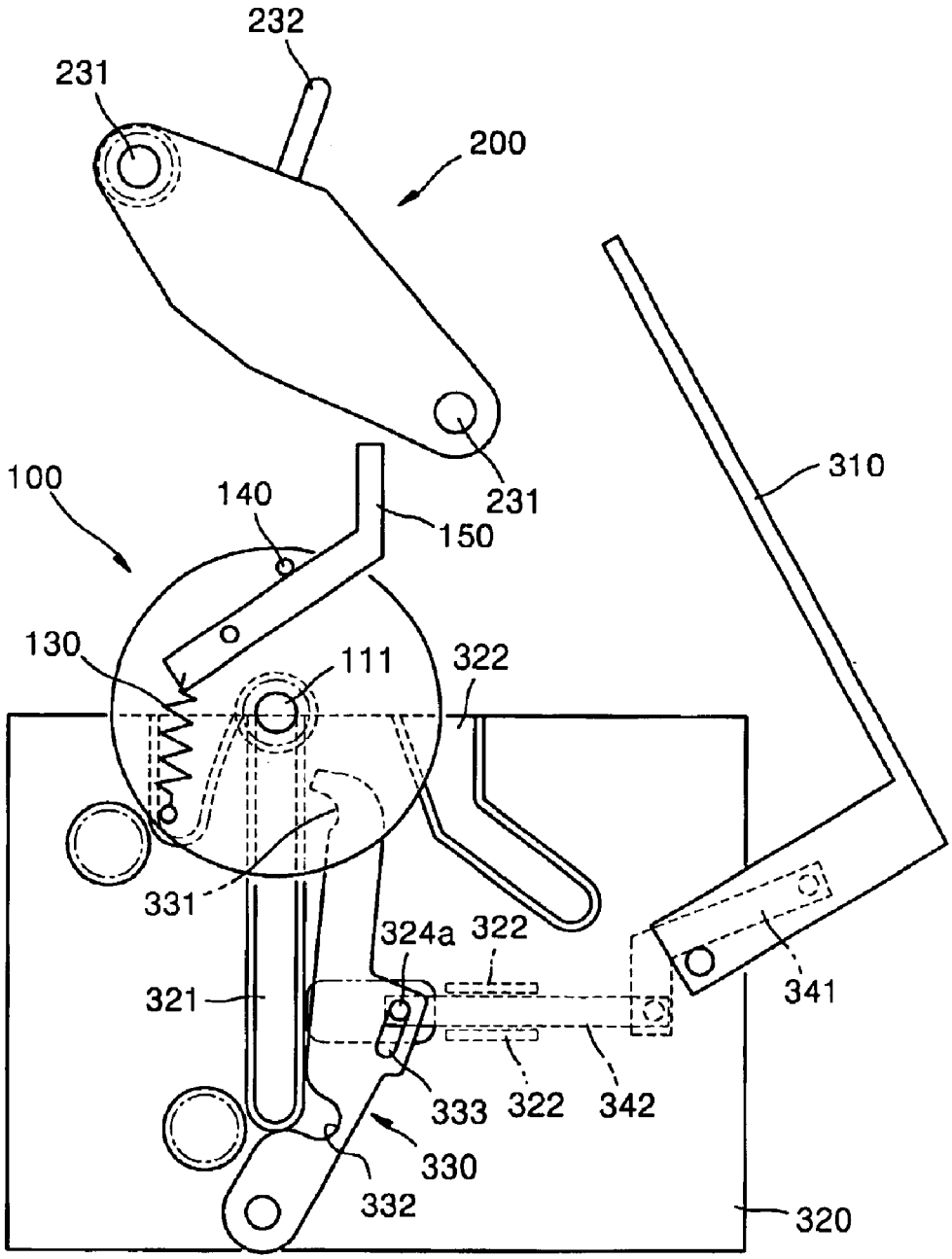
FIGS. 7 through 11 are views showing a process of replacing a photoreceptive unit and a transfer in the photoreceptive unit and transfer unit replacement system shown in FIG. 6.

Referring to FIG. 6, in a photoreceptive unit and transfer unit replacement system according to an embodiment of the present invention, an entrance 301 opened or closed by a door 310 is formed above a portion of a main body 300 of a printer where a photoreceptive unit 100 and a transfer unit 200 are installed. A replacement of the photoreceptive unit 100 and the transfer unit 200 is performed through the entrance 301. A frame 320 is installed at the main body 300, and first and second guide rails 321 and 322 are provided at the frame 320. The first guide rail 321 guides the photoreceptive unit 100 which enters through the entrance 301 and moves downward. The second guide rail 322 guides the transfer unit 200 which is moved down to enter the main body 300 through the entrance 301.

The photoreceptive unit 100 includes a photoreceptive drum 110, a plate 120 installed at each of both end sides of the photoreceptive drum 110, and a handle member 150. The handle member 150 includes a pair of rotating bars 151 rotatably installed at the respective plates 120 and a connection bar 152 connecting the rotating bars 151. The hand member 150 is elastically biased by a spring 130 in a direction in which the connection bar 152 ascends, that is, in a direction in which the rotation bar 151 is stopped by a stopper 140 provided at the plate 120.

The transfer unit 200 includes a transfer belt 220 circulating around a plurality of rollers 230 along an endless path and a case 210 enclosing and protecting the transfer belt 220. A lower surface of the case 210 is open to access the photoreceptive drum 110 and a sheet of paper (not shown). The transfer unit 200 further includes a handle member 232 provided at the case 210 so that a user can lift the transfer unit 200. The handle member 232 is rotatably installed at the case 210 so that, when the handle member 232 is not in use, the handle member 232 can be folded to closely contact the case 210.

A locking unit is provided to lock the photoreceptive unit 100 and the transfer unit 200 installed in the main body 300 along the first and second guide rails 321 and 322. The locking unit performs locking and unlocking according to an operation of opening and closing the door 310. The locking unit includes a locking lever 330 pivotably installed at the frame 320 and having first and second hook portions 331 and 332, and first and second link members 341 and 342 connecting the door 310 and the locking lever 330. The first and second link members 341 and 342 have first ends connected to each other and second ends connected to the door 310 and the locking lever 33, respectively. The locking unit further includes a support rail 323 provided at the frame 320 to slidably support the second link member 342, and a slot 333 into which a coupling protrusion 342*a* of the second link member 342 is inserted. Thus, when the door 310 is closed, the first and second link members 341 and 342 are moved to a direction A on FIG. 6, and accordingly the locking lever 330 is rotated counterclockwise. To the contrary, when the door 310 is open, the first and second link members 341 and 342 are moved to a right side of the drawing, and accordingly the locking lever 330 is rotated clockwise. When the locking lever 330 is rotated counterclockwise, the first and second hook portions 331 and 332 of the locking lever 330 are hooked by bosses 111 and 231 provided at the photoreceptive unit 100 and the transfer unit 220, respectively, so that the photoreceptive and transfer units 100 and 200 are locked at the same time.

In the above structure, when a new photoreceptive unit and a transfer unit are installed at the main body 300 of the printer, the door 310 is opened and the new photoreceptive unit is inserted through the entrance 031. Here, the boss 111 provided at the photoreceptive unit 100 slides on the first guide rail 321 and is guided to an installation position. The boss 111 is formed by extending a rotation shaft of the photoreceptive drum 110. When the photoreceptive unit 100 is completely installed, power of a driving source 401 in the main body 300 is transferred to the boss 111.

Figure 8:
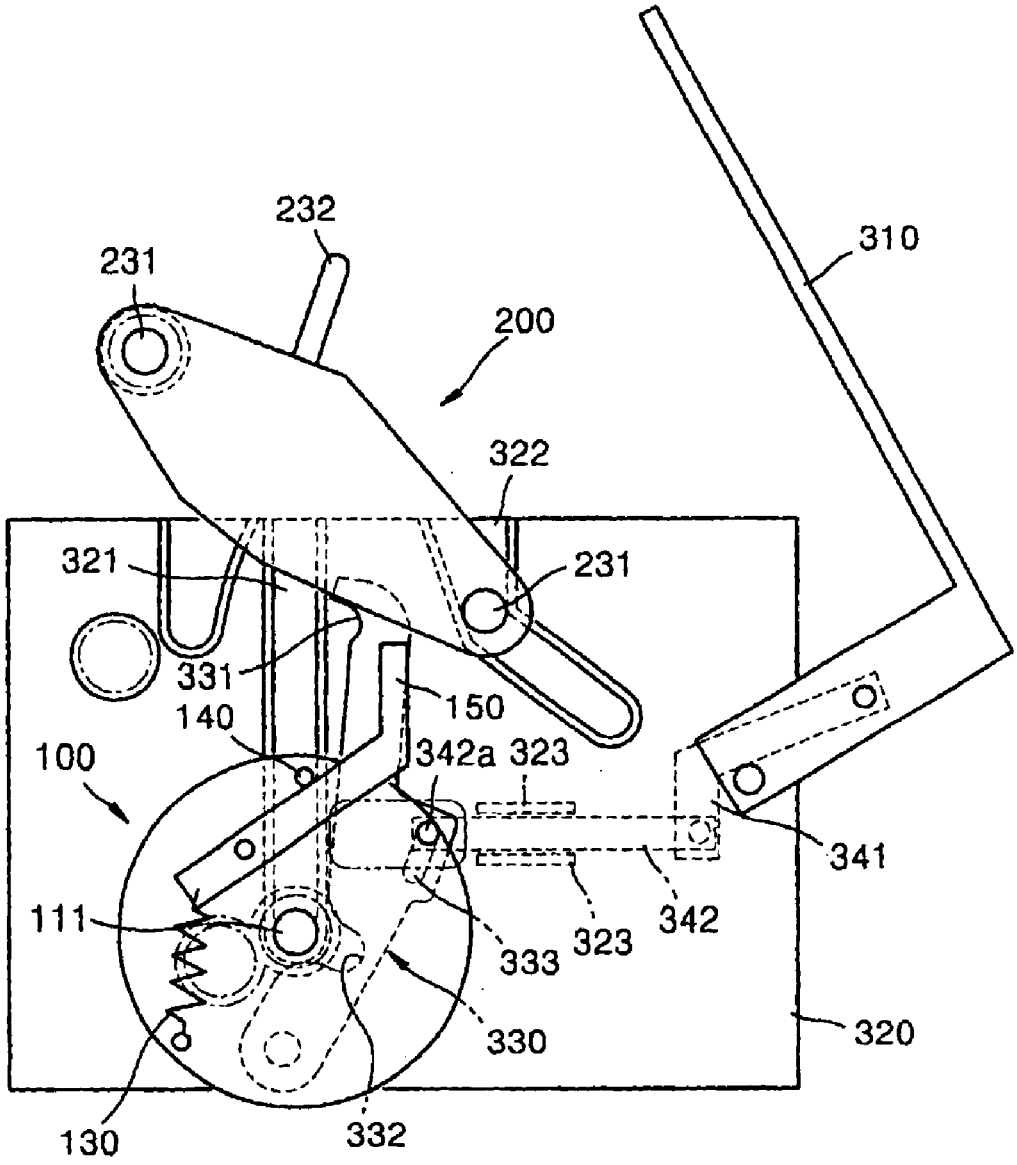
Figure 9:
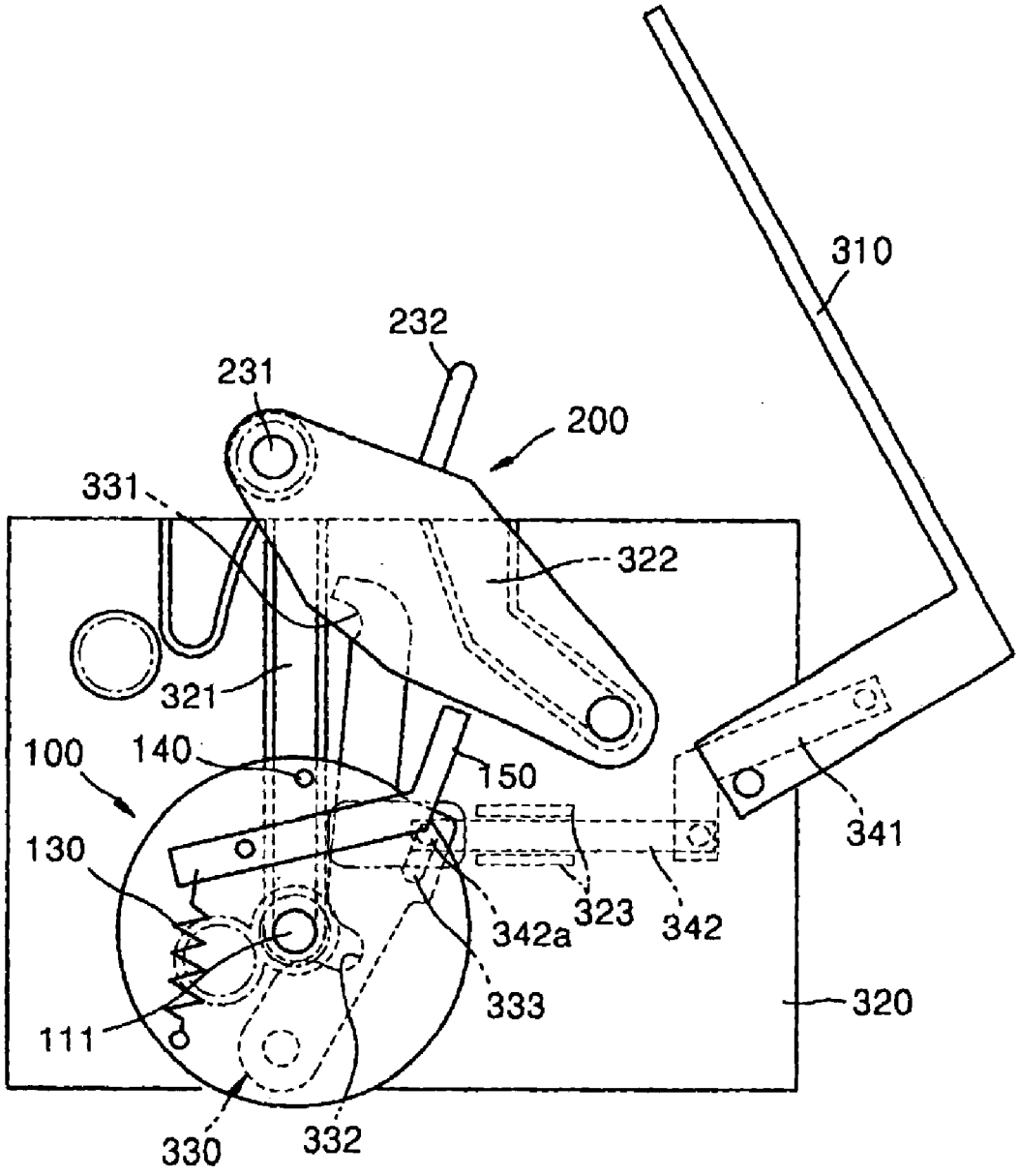
Figure 10:
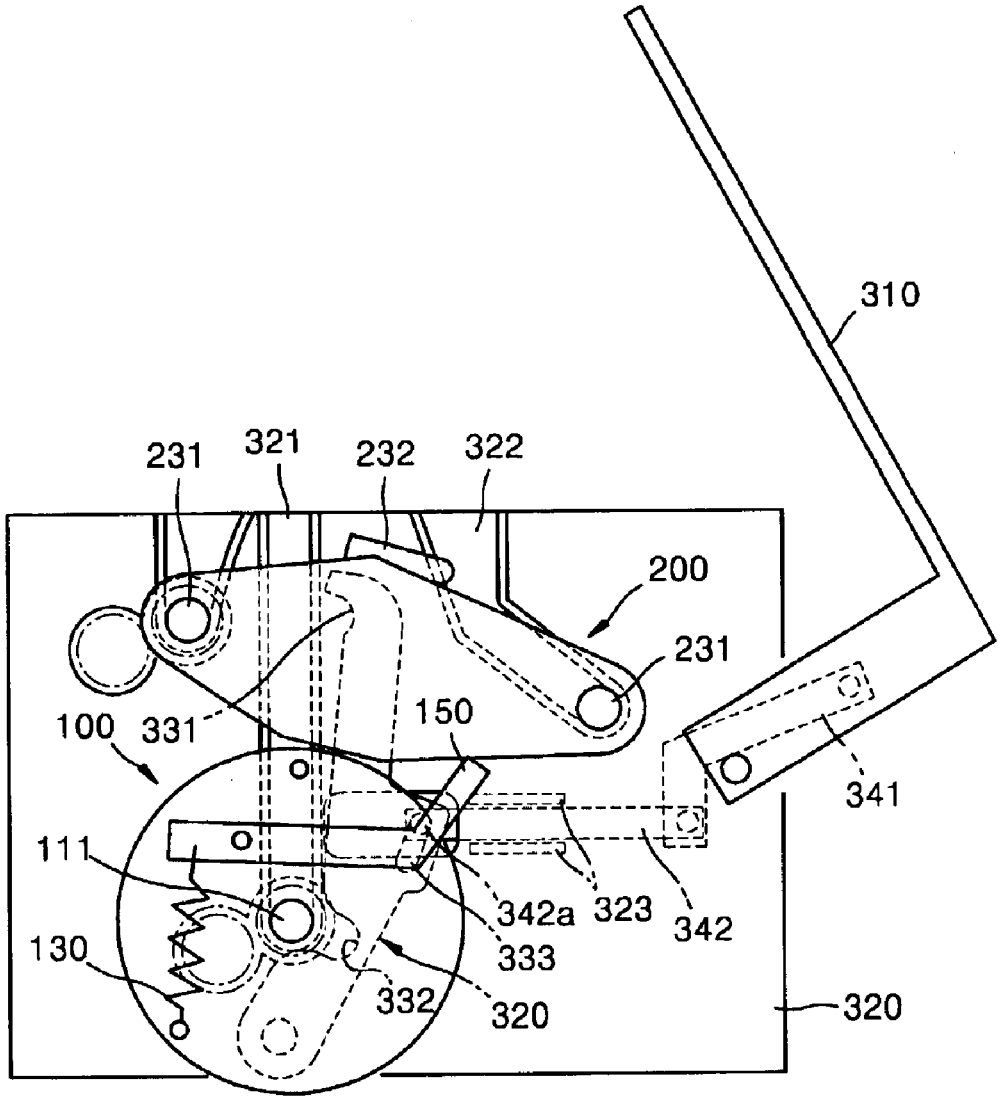

Next, the transfer unit 200 is inserted through the entrance 301 in an order of FIG. 8 to FIG. 10. Here, the boss 231 of the transfer unit 200 slides along the second guide rail 322 to be guided to an installation position. The boss 231 is formed by extending from a rotation shaft of the roller 230 which supports the transfer belt 220. When the transfer unit 200 is completely installed, the rotation shaft of one of the rollers 230 is connected to another driving source 402 in the main body 300. Here, the handle member 150 of the photoreceptive unit 100 is pressed by the transfer unit 200 to return to a laid position as shown in FIG. 10. The handle member 232 of the transfer unit 200 is manually laid down to closely contact the case 210.

Figure 11:
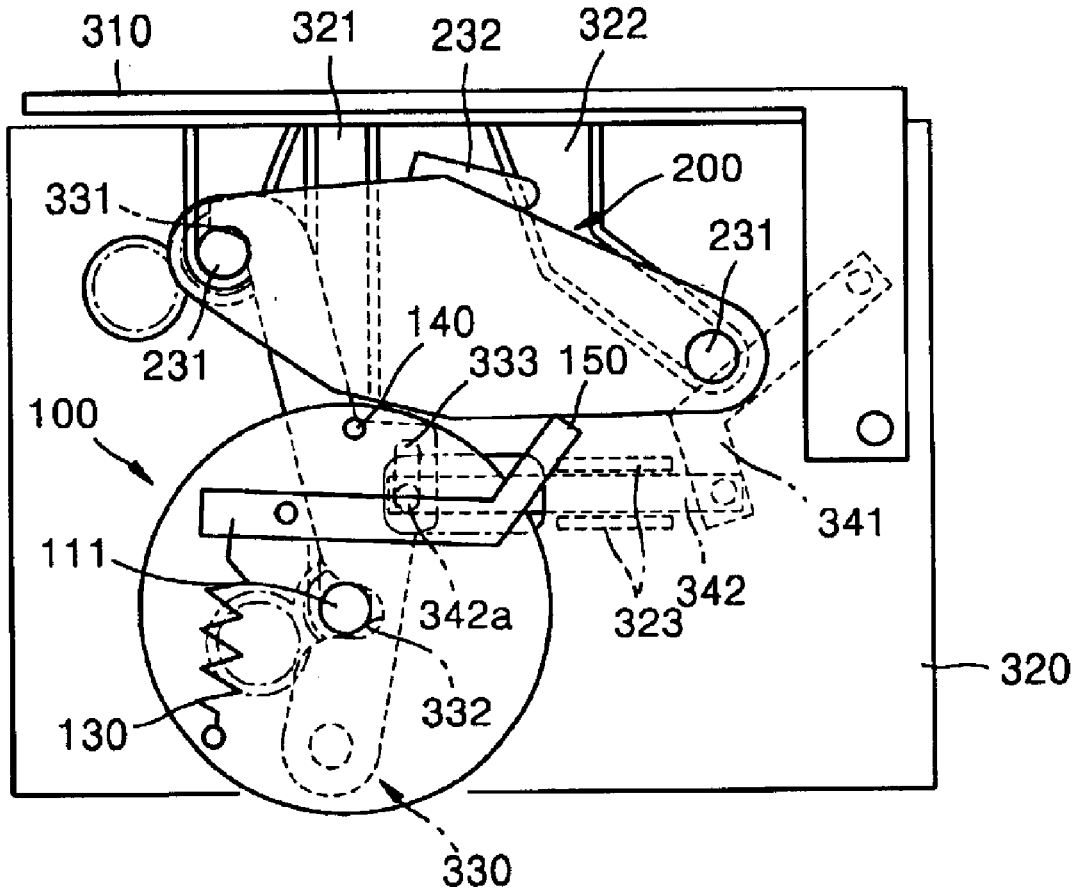

When the above installation of the photoreceptive unit 100 and the transfer unit 200 is completed, the door 310 is closed. Here, the locking lever 330 connected to the door 310 via the first and second link members 341 and 342 is rotated counterclockwise as shown in FIG. 11, and the first and second hook portions 331 and 332 are hooked by the bosses 111 and 231 of the photoreceptive unit 100 and the transfer unit 200, respectively. Thus, the photoreceptive unit 100 and the transfer unit 200 maintain a stable locking state by the first and second hook portions 331 and 332.

In contrast, when the door 310 is opened to take out the photoreceptive unit 100 and the transfer unit 200, the locking lever 330 connected to the first and second link members 341 and 342 are rotated clockwise to be in a state shown in FIG. 10, and the locking state by the first and second hook portions 331 and 332 is removed. In this state, the transfer unit 200 is lifted out from the printer by holding the handle member 232 of the transfer unit 200 in a reverse order of the above insertion process. When the transfer unit 200 is completely taken out of the main body 300, the handle member 150 of the photoreceptive unit 100 pressed by the transfer unit 200 is erected by a restoration force of the spring 130 as shown in FIG. 8. Thus, a user pulls out the photoreceptive unit 100 through the entrance 301 by holding the handle member 150 that is erected.

Since the operation of locking and unlocking the photoreceptive unit 100 and the transfer unit 200 are simultaneously performed by the operation of opening and closing the door 310, a replacement process can be performed conveniently. Also, since the photoreceptive unit 100 and the transfer unit 200 are lifted while the handle members 150 and 232 provided at the respective photoreceptive and transfer units 100 and 200, a possibility of dropping and damaging the photoreceptive and transfer units 100 and 200 as they are pulled from a front side of the printer while front portions thereof are held by the user according to a conventional method, is reduced.

As described above, in the photoreceptive unit and transfer unit replacement system according to the present invention, since the operation of opening and closing the door are performed according to the operation of locking and unlocking the respective photoreceptive and transfer units, and the photoreceptive unit and transfer units pass through the entrance disposed above the photoreceptive unit and transfer units, a replacement process can be performed more conveniently and stably.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A photoreceptive unit and transfer unit replacement system of a printer having a photoreceptive unit and a transfer unit disposed in a frame of a main body, comprising:

a door opening and closing an entrance formed above a portion of the main body where the photoreceptive unit and the transfer unit are installed in the main body of the printer;

a first guide rail provided at the frame of the main body to guide the photoreceptive unit which enters the main body through the entrance and descends;

a second guide rail provided at the frame to guide the transfer unit which enters the main body through the entrance and descends; and a locking unit locking and unlocking the photoreceptive unit and the transfer unit according to an operation of opening and closing the door, the locking unit having a locking lever rotatably installed at the frame and having a first locking portion, wherein each of the photoreceptive unit and the transfer unit includes a second locking portion, and wherein the first locking portion is locked by the second locking portion.

2. The system as claimed in claim 1, wherein:

each of the photoreceptive unit and the transfer unit comprises, a boss; and the locking unit-comprises, a locking lever rotatably installed at the frame and having a hook portion hooked by the boss provided at each of the photoreceptive unit and the transfer unit, and an interaction mechanism allowing an operation of opening and closing the door to be interacted with a rotation of the locking lever;

wherein when the door is closed, the locking lever is rotated in a first direction, and the hook portion is hooked by the corresponding boss to lock the photoreceptive unit and the transfer unit, and, when the door is opened, the locking lever is rotated in a second direction so as to be unlocked from the hook portion.

3. The system as claimed in claim 2, wherein the interaction mechanism comprises:

a slot portion formed on the locking lever; and a link member inserted into the slot portion to connect the locking lever and the door.

4. The system as claimed in claim 1, wherein the photoreceptive unit comprises:

a photoreceptive drum;

a plate installed at each of both side surfaces of the photoreceptive drum;

a handle member including a pair of rotation bars rotatably installed at the respective plates and a connection bar connecting the rotation bars;

an elastic member elastically biasing the handle member in a direction in which the connection bar ascends; and a stopper restricting a range of a movement of the handle member elastically rotated by the elastic member.

5. The system as claimed in claim 1, wherein the transfer unit comprises:

a transfer belt;

a case protecting the transfer belt; and a handle member installed to be foldable and unfoldable onto the case.

6. A photoreceptive unit and transfer unit replacement system of a printer having a photoreceptive unit and a transfer unit disposed in a frame of a main body, comprising:

a door opening and closing an entrance formed on the main body where the photoreceptive unit and the transfer unit are installed in the main body of the printer;

a first guide rail formed on the frame of the main body to guide the photoreceptive unit to an installation position of the main body through the entrance in a direction having a first angle with a plane of a sheet of paper which passes between the photoreceptive unit and the transfer unit;

a second guide rail provided at the frame to guide the transfer unit to the installation position of the main body through the entrance in the direction having a second angle with the plane of the paper; and a locking unit locking and unlocking the photoreceptive unit and the transfer unit, the locking unit having a locking lever rotatably installed at the frame and having a first locking portion, wherein each of the photoreceptive unit and the transfer unit includes a second locking portion, and wherein the first locking portion is locked by the second locking portion.

7. The system of claim 6, wherein the locking unit locks the photoreceptive unit and the transfer unit in the installation position according to a movement of the door.

8. The system of claim 6, wherein the frame of the main body comprises first and second sub-frames disposed on both sides of a paper feeding path of the paper.

9. The system of claim 8, wherein the photoreceptive unit and the transfer unit are disposed between the first and second sub-frames.

10. The system of claim 8, wherein the first guide rail comprises:

first and second photoreceptive guide rails formed on corresponding ones of the first and second sub-frames to guide both ends of the photoreceptive unit into the installation position of the main body.

11. The system of claim 10, wherein the photoreceptive unit comprises:

a rotation shaft about which the photoreceptive unit rotates; and bosses formed on both sides of the photoreceptive unit in the same direction as a longitudinal axis of the rotation shaft to be inserted into the first and second photoreceptive guide rails, respectively.

12. The system of claim 11, wherein the locking unit is disposed on the frame to be coupled to at least one of the bosses of the photoreceptive unit to lock the photoreceptive unit in the installation position according to a movement of the door.

13. The system of claim 12, wherein the locking unit comprises first and second locking levers pivotably mounted on the first and second sub-frame, respectively.

14. The system of claim 8, wherein the second guide rail comprises:

first and second transfer guide rails formed on corresponding ones of the first and second sub-frames to guide both ends of the transfer unit into the installation position of the main body.

15. The system of claim 14, wherein the transfer unit comprises:

a first roller having a rotation shaft about which the first roller rotates; and first bosses formed on both sides of the transfer roller in the same direction as a longitudinal axis of the rotation shaft to be inserted into the first and second transfer guide rails, respectively.

16. The system of claim 15, wherein:

the second guide rail comprises, third and fourth transfer guide rails formed on the corresponding ones of the first and second sub-frames to guide the both ends of the transfer unit into the installation position of the main body; and the transfer unit comprises, a second roller having a second rotation shaft about which the second roller rotates, and second bosses formed on the both sides of the transfer roller in the same direction as the longitudinal axis of the second rotation shaft to be inserted into the third and fourth transfer guide rails, respectively.

17. The system of claim 16, wherein the first and second transfer guide rails are disposed opposite to the third and fourth transfer rails with respect to a rotation shaft about which the photoreceptive unit rotates.

18. The system of claim 17, wherein the locking unit is coupled to at least one of the first and second bosses to lock the transfer unit in the installation position according to a movement of the door.

19. The system of claim 18, wherein the locking unit comprises first and second locking levers pivotably mounted on the first and second sub-frames, respectively.

20. The system of claim 8, further comprising:

a driving source mounted on one of the first and second sub-frames to rotate the photoreceptive unit and the transfer unit.

21. The system of claim 8, further comprising:

a rotation gear rotatably installed on one of the first and second sub-frames to rotate the photoreceptive unit and the transfer unit.

22. The system of claim 6, further comprising:

a driving source mounted on the frame to rotate the photoreceptive unit and the transfer unit.

23. A photoreceptive unit and transfer unit replacement system of a printer having a main body, a photoreceptive unit, and a transfer unit, comprising:

a door opening and closing an entrance formed on the main body where the photoreceptive unit and the transfer unit are installed in the main body of the printer;

first and second frames disposed on both sides of the photoreceptive unit and the transfer unit in a direction perpendicular to rotation axes of the photoreceptive unit and the transfer unit;

a guide formed on at least one of the first and second frames to guide the photoreceptive unit and the transfer unit to an installation position of the main body through the entrance; and a locking unit locking and unlocking the photoreceptive unit and the transfer unit, the locking unit having a locking lever rotatably installed at the frame and having a first locking portion, wherein each of the photoreceptive unit and the transfer unit includes a second locking portion, and wherein the first locking portion is locked by the second locking portion.

24. The system of claim 23, wherein the photoreceptive unit and the transfer unit comprise a rotation axis parallel to the rotation axes, and the guide is formed in a direction perpendicular to the rotation axes of the photoreceptive unit and the transfer unit.

25. The system of claim 23, wherein the photoreceptive unit and the transfer unit are inserted into the main body through the entrance in a direction from the transfer unit to the photoreceptive unit, and the guide is formed in the direction.

26. The system of claim 23, wherein the guide comprises:

a first guide rail formed on at least one of the first and second frames to guide the photoreceptive unit to the installation position; and a second guide rail formed on at least one of the first and second frames to guide the transfer unit to the installation position.

27. The system of claim 26, wherein the first guide rail has a first length in a direction having an angle with a paper path of a sheet of paper passing between the photoreceptive unit and the transfer unit, and the second guide rail has a second length shorter than the second length in the direction.

28. The system of claim 26, wherein the first guide rail is disposed in a straight line, and the second guide rail is disposed in a curved line.

29. The system of claim 26, wherein the second guide rail comprises first and second transfer rails disposed opposite to each other with respect to the first guide rail.

30. The system of claim 23, wherein the photoreceptive unit comprises a plate parallel to the first and second frames and a handle rotatably mounted on the plate, and the handle of the photoreceptive unit rotates according to a movement of the transfer unit along the guide.

31. The system of claim 23, wherein the transfer unit comprises a plate perpendicular to the first and second frames and a handle rotatably mounted on the plate, and the handle of the transfer unit rotates about the rotation axis of the transfer unit.

32. A photoreceptive unit and transfer unit replacement system of a printer having a photoreceptive unit and a transfer unit contained in a main body, comprising:

a door opening and closing an entrance formed on the main body;

first and second frames parallel to each other and formed in a direction perpendicular to rotation axes of the photoreceptive unit and the transfer unit so that the photoreceptive unit and the transfer unit are disposed between the first and second frames;

a first guide rail formed on at least one of the first and second frames;

a first side plate formed on the photoreceptive unit in a first direction parallel to the first and second frames;

a first boss formed on the first side plate of the photoreceptive unit in a second direction parallel to the rotation axis of the photoreceptive unit, and disposed on the first guide rail;

a second guide rail formed on at least one of the first and second frames;

a second side plate formed on the transfer unit in the first direction parallel to the first and second frames;

a second boss formed on the second side plate of the transfer unit in the second direction parallel to the rotation axis of the transfer unit, and disposed on the second guide rail; and a locking unit locking and unlocking the photoreceptive unit and the transfer unit, the locking unit having a locking lever rotatably installed at the frame and having a first locking portion, wherein each of the photoreceptive unit and the transfer unit includes a second locking portion, and wherein the first locking portion is locking by the second locking portion.

33. The system of claim 32, wherein the first and second guide rails are formed in a direction having an angle with a paper path of a sheet of paper passing through a nip between the photoreceptive unit and the transfer unit.

34. The system of claim 32, wherein the locking unit has a first locking portion and a second locking portion coupled to the transfer unit and the photoreceptive unit, respectively, wherein the first locking portion and the second locking portion are formed in a direction from the transfer unit to the photoreceptive unit.

35. The system of claim 32, wherein the locking unit is rotatably mounted on the one of the first and second frames to rotate according to a movement of the door, and having a first locking portion and a second locking portion locking the transfer unit and the photoreceptive unit, respectively.

36. The system of claim 32, wherein the photoreceptive unit and the transfer unit are mounted in the main body through the entrance, and the transfer roller comprises:

a first side facing the photoreceptive unit; and a second side facing the entrance of the main body.

37. The system of claim 32, wherein the photoreceptive unit, the transfer unit, and the entrance are disposed in the main body a line parallel to the first and second frames.

38. The system of claim 32, wherein the photoreceptive unit, the transfer unit, and the entrance are disposed in the main body a line having an angle with a paper path of a sheet of paper passing through a nip between the photoreceptive unit and the transfer unit.

39. A printer having a photoreceptive unit and transfer unit replacement system replacing a photoreceptive unit and a transfer unit disposed in a frame of a main body, comprising:

a door opening and closing an entrance formed on the main body where the photoreceptive unit and the transfer unit are installed in the main body of the printer;

a first guide rail formed on the frame of the main body to guide the photoreceptive unit to an installation position of the main body through the entrance in a first direction having a first angle with a plane of a sheet of paper which passes between the photoreceptive unit and the transfer unit;

a second guide rail formed on the frame of the main body to guide the transfer unit to the installation position of the main body through the entrance in a second direction having a second angle with the plane of the paper; and a locking unit locking and unlocking the photoreceptive unit and the transfer unit, the locking unit having a locking lever rotatably installed at the frame and having a first locking portion, wherein each of the photoreceptive unit and the transfer unit includes a second locking portion, and wherein the first locking portion is locked by the second locking portion.

40. The printer of claim 39, wherein the locking unit locks the photoreceptive unit and the transfer unit in the installation position according to a movement of the door.

41. The printer of claim 39, wherein the frame of the main body comprises first and second sub-frames disposed on both sides of a paper feeding path of the paper, and the photoreceptive unit and the transfer unit are disposed between the first and second sub-frames so that rotation axes of the photoreceptive unit and the transfer unit are perpendicular to the first and second sub-frames.

42. The printer of claim 41, wherein the first guide rail comprises:

first and second photoreceptive guide rails formed on corresponding ones of the first and second sub-frames to guide both ends of the photoreceptive unit into the installation position of the main body.

43. The printer of claim 42, wherein the photoreceptive unit comprises:

a rotation shaft having the rotation axis about which the photoreceptive unit rotates; and bosses formed on both sides of the photoreceptive unit in the same direction as the rotation axis of the rotation shaft to be inserted into the first and second photoreceptive guide rails, respectively.

44. The printer of claim 41, wherein the second guide rail comprises:

first and second transfer guide rails formed on corresponding ones of the first and second sub-frames to guide both ends of the transfer unit into the installation position of the main body.

45. The printer claim 44, wherein the transfer unit comprises:

a first roller having a rotation shaft about which the first roller rotates; and bosses formed on both sides of the transfer roller in the same direction as a longitudinal axis of the rotation shaft to be inserted into the first and second transfer guide rails, respectively.

46. The printer of claim 45, wherein:

the second guide rail comprises, third and fourth transfer guide rails formed on the corresponding ones of the first and second sub-frames to guide the both ends of the transfer unit into the installation position of the main body; and the transfer unit comprises, a second roller having a second rotation shaft about which the second roller rotates, and second bosses formed on the both sides of the transfer roller in the same direction as the longitudinal axis of the second rotation shaft to be inserted into the third and fourth transfer guide rails, respectively.

47. The printer of claim 41, further comprising:

a driving source mounted on one of the first and second sub-frames to rotate the photoreceptive unit and the transfer unit.

48. A printer having a photoreceptive unit and transfer unit replacement system replacing a photoreceptive unit and a transfer unit disposed in a main body, comprising:

a door opening and closing an entrance formed on the main body where the photoreceptive unit and the transfer unit are installed in the main body of the printer;

first and second frames disposed on both sides of the photoreceptive unit and the transfer unit in a direction perpendicular to rotation axes of the photoreceptive unit and the transfer unit;

a guide formed on at least one of the first and second frames to guide the photorecptive unit and the transfer unit to an installation position of the main body through the entrance; and a locking unit locking and unlocking the photoreceptive unit and the transfer unit, the locking unit having a locking lever rotatably installed at the frame and having a first locking portion, wherein each of the photoreceptive unit and the transfer unit includes a second locking portion, and wherein the first locking portion is locked by the second locking portion.

49. The printer of claim 48, wherein the guide is formed in a direction perpendicular to the rotation axes of the photoreceptive unit and the transfer unit.

50. The printer of claim 48, wherein the photoreceptive unit and the transfer unit are inserted into the main body through the entrance in a direction from the transfer unit to the photoreceptive unit, and the guide is formed in the direction.

51. The printer of claim 48, wherein the guide comprises:

a first guide rail formed on at least one of the first and second frames to guide the photoreceptive unit to the installation position; and a second guide rail formed on at least one of the first and second frames to guide the transfer unit to the installation position.

52. The printer of claim 51, wherein the first guide rail has a first length in a direction having an angle with a paper path of a sheet of paper passing between the photoreceptive unit and the transfer unit, and the second guide rail has a second length shorter than the second length in the direction.

53. The printer of claim 51, wherein the first guide rail is disposed in a straight line, and the second guide rail is disposed in a curved line.

54. The printer of claim 51, wherein the second guide rail comprises first and second transfer rails disposed opposite to each other with respect to the first guide rail.

55. The printer of claim 48, wherein the photoreceptive unit comprises a plate parallel to the first and second frames and a handle rotatably mounted on the plate, and the handle of the photoreceptive unit rotates according to a movement of the transfer unit along the guide.

56. The system of claim 48, wherein the transfer unit comprises a plate perpendicular to the first and second frames and a handle rotatably mounted on the plate, and the handle of the transfer unit rotates about the rotation axis of the transfer unit.

57. A printer having a photoreceptive unit and transfer unit replacement system replacing a photoreceptive unit and a transfer unit disposed in a main body in a printer, the printer comprising:

a guide formed on the main body to guide the photoreceptive unit and the transfer unit to be replaced in first and second directions having first and second angles, respectively, with a plane of a sheet of paper passing between the photoreceptive unit and the transfer unit; and a locking unit locking and unlocking the photoreceptive unit and the transfer unit, the locking unit having a locking lever rotatably installed at the frame and having a first locking portion, wherein each of the photoreceptive unit and the transfer unit includes a second locking portion, and wherein the first locking portion is locked by the second locking portion.

58. The printer of claim 57, wherein the photoreceptive unit and the transfer unit comprise rotation axes, and the guide guides the photoreceptive unit and the transfer unit so that the rotation axis of the photoreceptive unit moves in the first direction, and the rotation axis of the transfer unit moves in the second direction when the photoreceptive unit and the transfer unit are installed in an installation position of the main body.

59. A photoreceptive unit and transfer unit replacement method of replacing a photoreceptive unit and a transfer unit disposed in a frame of a main body in a printer having a door opening and closing an entrance formed on the main body where the photoreceptive unit and the transfer unit are installed, and first and second guide rails formed on the frame of the main body, the method comprising:

guiding the photoreceptive unit along the first guide rail to an installation position of the main body through the entrance in a first direction having a first angle with a plane of a sheet of paper which passes between the photoreceptive unit and the transfer unit;

guiding the transfer unit along the second guide to the installation position of the main body through the entrance in a second direction having a second angle with the plane of the paper; and locking the photoreceptive unit and the transfer unit according to an operation of opening and closing the door via a locking unit having a locking lever rotatably installed at the frame and having a first locking portion, wherein each of the photoreceptive unit and the transfer unit includes a second locking portion, and wherein the first locking portion is locked by the second locking portion.

60. A photoreceptive unit and transfer unit replacement method of replacing a photoreceptive unit and a transfer unit disposed in a main body in a printer having a door opening and closing an entrance formed on the main body where the photoreceptive unit and the transfer unit are installed, first and second frames disposed on both sides of the photoreceptive unit and the transfer unit in a direction perpendicular to rotation axes of the photoreceptive unit and the transfer unit, and a guide formed on at least one of the first and second frames, the method comprising:

guiding the photoreceptive unit and the transfer unit along the guide to an installation position of the main body through the entrance; and locking the photoreceptive unit and the transfer unit according to an operation of opening and closing the door via a locking unit having a locking lever rotatably installed at the frame and having a first locking portion, wherein each of the photoreceptive unit and the transfer unit includes a second locking portion, and wherein the first locking portion is locked by the second locking portion.

61. A photoreceptive unit and transfer unit replacement method of replacing a photoreceptive unit and a transfer unit disposed in a main body in a printer, the method comprising:

guiding the photoreceptive unit and the transfer unit to be replaced in first and second directions having first and second angles, respectively, with a plane of a sheet of paper passing between the photoreceptive unit and the transfer unit; and locking the photoreceptive unit and the transfer unit according to an operation of opening and closing the door via a locking unit having a locking lever rotatably installed at the frame and having a first locking portion, wherein each of the photoreceptive unit and the transfer unit includes a second locking portion, and wherein the first locking portion is locked by the second locking portion.

62. The method of claim 61, wherein the photoreceptive unit and the transfer unit comprise rotation axes, and the guiding of the photoreceptive unit and the transfer unit comprises:

guiding the rotation axis of the photoreceptive unit to move in the first direction; and guiding the rotation axis of the transfer unit to move in the second direction when the photoreceptive unit and the transfer unit are installed in an installation position of the main body.

63. The system of claim 1, wherein the locking lever has a hook portion as the first locking portion, each of the photoreceptive unit and the transfer unit comprises a boss as the second locking portion, and the hook portion is hooked by the bosses.

* * * * *

UNITED STATES PATENT AND TRADEMARK OFFICE

CERTIFICATE OF CORRECTION

PATENT NO. : 6,941,093 B2
APPLICATION NO. : 10/439330
DATED : September 6, 2005
INVENTOR(S) : Moon-bae Park et al.

It is certified that error appears in the above-identified patent and that said Letters Patent is hereby corrected as shown below:

Title page,
Item [75], Inventors, replace “Gyeonnggi-do” with -- Gyeonggi-do --.

Column 6,
Line 17, replace “unit-comprises” with -- unit comprises --.

Column 9,
Line 59, after “portion is” replace “locking” with -- locked --.

Column 11,
Line 16, replace “printer” with -- printer of --.
Line 54, replace “photorecptive” with -- photoreceptive --.

Signed and Sealed this

Twenty-seventh Day of June, 2006

JON W. DUDAS
*Director of the United States Patent and Trademark Office*